US011040789B2

(12) United States Patent
Vaughn et al.

(10) Patent No.: US 11,040,789 B2
(45) Date of Patent: Jun. 22, 2021

(54) COMBINATION WIRE AND PLASTIC STRAPPING DEVICE

(71) Applicant: Accent Packaging, Inc., Tomball, TX (US)

(72) Inventors: Mark A. Vaughn, Neosho, MO (US); Timothy Charles Stamps, Carl Junction, MO (US); James R. York, Carthage, MO (US)

(73) Assignee: Accent Wire Holdings LLC, Tomball, TX (US)

( * ) Notice: Subject to any disclaimer, the term of this patent is extended or adjusted under 35 U.S.C. 154(b) by 95 days.

(21) Appl. No.: 16/433,118

(22) Filed: Jun. 6, 2019

(65) Prior Publication Data

US 2019/0322397 A1 Oct. 24, 2019

Related U.S. Application Data

(63) Continuation-in-part of application No. 15/018,638, filed on Feb. 8, 2016, now Pat. No. 10,351,274, which (Continued)

(51) Int. Cl.

| | |
|---|---|
| ***B65B 13/08*** | (2006.01) |
| ***B65B 13/26*** | (2006.01) |
| ***B65B 13/32*** | (2006.01) |

(52) U.S. Cl.

CPC ..... *B65B 13/08* (2013.01); *B65B 13/26* (2013.01); *B65B 13/32* (2013.01)

(58) Field of Classification Search

CPC ..... B65B 13/06; B65B 13/08; B65B 13/26; B65B 13/32; B65B 59/00; B65B 27/12; B65B 27/125

(Continued)

(56) References Cited

U.S. PATENT DOCUMENTS

| | | | |
|---|---|---|---|
| 25,783 | A | 10/1859 | White |
| 1,460,649 | A | 7/1923 | Gerrard |

(Continued)

FOREIGN PATENT DOCUMENTS

| | | |
|---|---|---|
| CN | 2050497 | 1/1990 |
| CN | 2451448 | 10/2001 |

(Continued)

OTHER PUBLICATIONS

Brian Taylor, "Fit to be tied: the right wire-tying system conserves costs while keeping bales in ship-shape," Baler Focus, Recycling Today, Feb. 2003. (5 pages).

(Continued)

*Primary Examiner* — Adam J Eiseman
*Assistant Examiner* — Bobby Yeonjin Kim
(74) *Attorney, Agent, or Firm* — Stephens Domnitz Meineke, PLLC

(57) ABSTRACT

A system and method of using a combination strapping machine including a wire tying system and a plastic tying system is provided. Embodiments of the strapping machine include a common frame coupled to a wire strapping system, a single wire track, a plastic strapping system, and a single plastic track. Some embodiments of the combination strapping machine include a strapping machine frame having a common track perimeter. Further, the strapping machine includes a plastic tying system configured to apply a plastic strap to a baled material, and a wire tying system configured to apply a wire strap to the baled material. Some embodiments of the strapping machine include a common track for the wire tying system and plastic tying system. Some embodiments of the strapping machine include a common frame for the wire tying system and plastic tying system with a non-common track. Other embodiments of the combination strapping machine are controlled by a common control (Continued)

system that coordinates both plastic and wire strapping according to a predetermined order of strap application.

9 Claims, 9 Drawing Sheets

Related U.S. Application Data is a continuation-in-part of application No. 14/185,524, filed on Feb. 20, 2014, now Pat. No. 9,278,772.

(58) Field of Classification Search
USPC ..... 100/26, 30, 31, 33 R, 33 P
See application file for complete search history.

(56) References Cited

U.S. PATENT DOCUMENTS

| | | | | |
|---|---|---|---|---|
| 1,868,141 | A | 7/1932 | Harvey | |
| 1,939,746 | A | 12/1933 | Whitman | |
| 2,756,783 | A | 7/1956 | Osuch | |
| 2,853,885 | A | 9/1958 | Seltzer | |
| 2,859,687 | A | 11/1958 | Hill | |
| 2,907,356 | A | 10/1959 | Mille | |
| 2,922,359 | A | 1/1960 | Brouse et al. | |
| 2,963,958 | A | 12/1960 | Nelson et al. | |
| 3,037,534 | A | 6/1962 | Brouse | |
| 3,037,535 | A | 6/1962 | Linehan et al. | |
| 3,056,450 | A | 4/1963 | Tarbox | |
| 3,099,204 | A | 7/1963 | Stromberg | |
| 3,232,216 | A | 2/1966 | Cranston, Jr. et al. | |
| 3,251,296 | A | 5/1966 | Smith | |
| 3,295,436 | A | 1/1967 | Brouse et al. | |
| 3,327,618 | A | 6/1967 | Cook | |
| 3,338,273 | A | 8/1967 | Kalning | |
| 3,447,448 | A | 6/1969 | Pasic | |
| 3,880,204 | A | 4/1975 | Sarff et al. | |
| 3,888,134 | A | 6/1975 | Miranda | |
| 3,889,564 | A | 6/1975 | Bergeforsen et al. | |
| 4,079,667 | A | 3/1978 | Lems | |
| 4,114,527 | A | 9/1978 | O'Neill | |
| 4,164,176 | A | 8/1979 | Brouse et al. | |
| 4,177,842 | A | 12/1979 | Dilley | |
| 4,252,157 | A | 2/1981 | Ohnishi | |
| 4,302,991 | A | 12/1981 | Brouse et al. | |
| 4,403,542 | A | 9/1983 | Lewis | |
| 4,566,378 | A | 1/1986 | Fleissner | |
| 4,577,554 | A | 3/1986 | Brouse | |
| 4,587,791 | A | 5/1986 | Brouse et al. | |
| 4,611,534 | A | 9/1986 | Kudlicka | |
| 4,655,264 | A | 4/1987 | Dilley | |
| 4,730,434 | A | 3/1988 | Knudsen | |
| 4,739,700 | A | 4/1988 | Brouse et al. | |
| 4,817,519 | A | 4/1989 | Brouse et al. | |
| 4,827,991 | A | 5/1989 | Jacobsen et al. | |
| 4,838,016 | A * | 6/1989 | Frogbrook | E02B 3/125 56/341 |
| 5,078,057 | A * | 1/1992 | Pearson | B65B 27/086 100/25 |
| 5,392,821 | A | 2/1995 | Chudy | |
| 5,400,706 | A * | 3/1995 | Tipton | B65B 13/06 100/14 |
| 5,433,255 | A | 7/1995 | Wiedel | |
| 5,467,804 | A | 11/1995 | Kupferschmidt et al. | |
| 5,494,081 | A | 2/1996 | Wiedel | |
| 5,577,760 | A | 11/1996 | Pressler | |
| 5,704,283 | A | 1/1998 | Wiedel | |
| 5,870,950 | A | 2/1999 | Wiedel | |
| 5,921,289 | A | 7/1999 | Johnson | |
| 6,009,646 | A | 1/2000 | Johnson | |
| 6,032,575 | A | 3/2000 | Johnson | |
| 6,283,017 | B1 | 9/2001 | Johnson et al. | |
| 6,341,470 | B1 * | 1/2002 | Lacey | A01F 15/071 53/176 |
| 6,363,843 | B1 | 4/2002 | Daniel et al. | |
| 6,571,691 | B1 | 6/2003 | Jones | |
| 6,640,700 | B2 | 11/2003 | Helland et al. | |
| 6,745,677 | B2 | 6/2004 | Pearson et al. | |
| 6,755,123 | B2 | 6/2004 | Flaum et al. | |
| 6,857,252 | B2 | 2/2005 | Haberstroh | |
| 6,920,741 | B2 | 7/2005 | Devine | |
| 6,923,113 | B2 | 8/2005 | Bobren et al. | |
| 6,957,835 | B2 | 10/2005 | Rotole | |
| 6,962,109 | B2 | 11/2005 | Bobren et al. | |
| 6,968,779 | B2 | 11/2005 | Doyle et al. | |
| 6,975,911 | B2 | 12/2005 | Stamps et al. | |
| 7,085,625 | B2 | 8/2006 | Timothy et al. | |
| 7,124,679 | B2 | 10/2006 | Daniel et al. | |
| 7,146,294 | B1 | 12/2006 | Waitkus | |
| 7,373,877 | B2 | 5/2008 | Wiedel | |
| 7,380,574 | B2 | 6/2008 | Wiedel | |
| 8,397,632 | B2 | 3/2013 | Millett et al. | |
| 8,757,055 | B2 | 6/2014 | Millet et al. | |
| 9,045,245 | B2 | 6/2015 | Giett | |
| 9,090,367 | B2 | 7/2015 | Millett et al. | |
| 9,278,772 | B2 | 3/2016 | Vaughn et al. | |
| 2003/0024404 | A1 * | 2/2003 | Daniel | B65B 13/06 100/3 |
| 2004/0006402 | A1 * | 1/2004 | Stamps | G05B 19/042 700/90 |
| 2004/0144264 | A1 | 7/2004 | Daniel et al. | |
| 2004/0250694 | A1 * | 12/2004 | Lynde | A01F 15/0715 100/8 |
| 2006/0042477 | A1 | 3/2006 | Daniel et al. | |
| 2006/0042478 | A1 | 3/2006 | Daniel et al. | |
| 2007/0056248 | A1 * | 3/2007 | Duschek | B65B 61/202 53/399 |
| 2009/0223388 | A1 * | 9/2009 | Doyle | B65B 13/06 100/1 |
| 2009/0250930 | A1 | 10/2009 | Eylenbosch et al. | |
| 2013/0019764 | A1 | 1/2013 | Yang | |
| 2013/0180416 | A1 | 7/2013 | Stein et al. | |
| 2013/0247515 | A1 | 9/2013 | Actis | |

FOREIGN PATENT DOCUMENTS

| | | |
|---|---|---|
| CN | 2527767 | 12/2002 |
| GB | 325783 | 5/1930 |
| GB | 417803 | 10/1934 |
| GB | 420098 | 11/1934 |
| GB | 474813 | 11/1937 |
| GB | 704931 | 3/1954 |
| GB | 984251 | 2/1965 |

OTHER PUBLICATIONS

"Bunding Demand Met by ISB," Converter The International Technical Publication for the Paper, Board, Film, and Foil Converter, Jul. 2003, vol. 40, Issue 7, p. 20. (2 pages).

Cranston Machinery Co., Inc., Oak Grove, Oregon, 1000 Series Wire Strapper, 25 pages (Excerpts from Manual). Sep. 1996.

"Samuel Strapping Systems.The Science of Strap Selection. Handbook [online]. Oct. 2, 2012 (Oct. 2, 2012) [retrieved on May 20, 2015]. Retrieved from the Internet: http://www.thomasnet.com/white-papers/abstract/101792/the-science-of-strap-selection.html".

European Office Action dated Feb. 2, 2016 in Application No. 12827753, 4 pages.

International Preliminary Report on Patentability dated Mar. 17, 2016 in Application No. PCT/US15/19446, 15 pages.

International Preliminary Report on Patentability dated Mar. 17, 2019 in Application No. PCT/US2014/053986, 7 pages.

Australian Office Action dated Apr. 1, 2016 in Application No. 2012302002, 3 pages.

* cited by examiner

COMBINATION WIRE AND PLASTIC STRAPPING DEVICE

CROSS-REFERENCE TO RELATED APPLICATIONS

This application is a continuation-in-part of, and claims priority to, pending U.S. Nonprovisional application Ser. No. 14/185,524, filed Feb. 20, 2014, titled "Combination Wire and Plastic Strapping Device," the entire contents of which are hereby incorporated by reference. This application is also a Continuation-in-part of, and claims priority to, pending U.S. application Ser. No. 15/018,638 filed Feb. 2, 2016, titled "Combination Wire and Plastic Strapping Device," the entire contents of which are hereby incorporated by reference.

STATEMENT REGARDING FEDERALLY SPONSORED RESEARCH OR DEVELOPMENT

Not applicable.

TECHNICAL FIELD

Embodiments of the present invention relate to a combination strapping machine including a wire tying system and a plastic tying system. More particularly, embodiments of the present invention relate to a combination strapping machine for baling recycled materials, having a common frame coupled to both a wire strapping system for applying a wire tying medium, and a plastic strapping system for applying a plastic tying medium.

BACKGROUND OF THE INVENTION

Traditional bulk-material baling machines incorporate a tying system for wrapping and/or securing the baled material, such as a wire tying system. In forming bales of compressible materials, it is important to surround the baled material with a tying medium having sufficient strength to maintain the form of the compressed bale for shipping and/or storage. At the same time, the tying medium used to secure a bale must be adequately tensioned by the tying system, as well as securely knotted and/or tied around the bale. As the characteristics of each type of tying medium are unique, a single baling machine typically uses a single tying medium with a single tying system coupled to the machine. As such, a baling machine is not able to vary the types of tying media applied to different portions of a single bale.

Accordingly, embodiments of the present invention introduce technology for resolving the above-mentioned issues conventionally experienced when varying the tying medium used for bulk-material baling systems.

In one embodiment of the invention, a combination strapping machine for use on a baler is provided. The strapping machine may include a strapping machine frame having a common track perimeter and a top side, a right side, a left side, and a bottom side; a plastic tying system coupled to one of the top side, the right side, the left side, or the bottom side of the strapping machine frame, the plastic tying system having a plastic track, wherein the plastic tying system is configured to apply a plastic strap to a baled material, the plastic tying system may include a plastic closing mechanism (such as a welder); and a wire tying system coupled to one of the top side, the right side, the left side, or the bottom side of the strapping machine frame, the wire tying system having a wire track, wherein the wire tying system is configured to apply a wire strap to the baled material, the wire tying system may include a wire closing mechanism (such as a knotter from a knotter assembly), wherein the wire track is adjacent to the plastic track, and further wherein the plastic closing mechanism may be spaced apart from the wire closing mechanism.

In another illustrative aspect, a combination strapping machine for dynamic strapping of a first tying medium and a second tying medium on a baler may include: a strapping machine frame having a common track perimeter; a first tying system for the first tying medium, the first tying system coupled to a first portion of the strapping machine; and a second tying system for the second tying medium, the second tying system coupled to a second portion of the strapping machine, wherein the first tying system and the second tying system are configured to alternate applying straps to a baled material secured by the combination strapping machine and alternate utilizing a common track when applying the strap to the baled material.

According to a third illustrative aspect, embodiments of the invention are directed to a method for strapping a baled material according to a predetermined order of strap application, the method comprising: receiving, by a strapping machine, a material for baling, wherein the strapping machine comprises a first tying assembly, a second tying assembly, and a common control system configured to automatically alternate control indications between the first tying assembly and the second tying assembly; applying at least one strap of a first tying medium according to the predetermined order of strap application and in response to one or more control indications from the common control system, wherein the at least one strap of the first tying medium is applied using the first tying assembly coupled to the strapping machine; and applying at least one strap of a second tying medium according to the predetermined order of strap application and in response to one or more control indications from the common control system, wherein the at least one strap of the second tying medium is applied using the second tying assembly coupled to the strapping machine.

Additional objects, advantages, and novel features of the invention will be set forth in part in the description that follows, and in part will become apparent to those skilled in the art upon examination of the following or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION OF THE INVENTION

Figure 1:
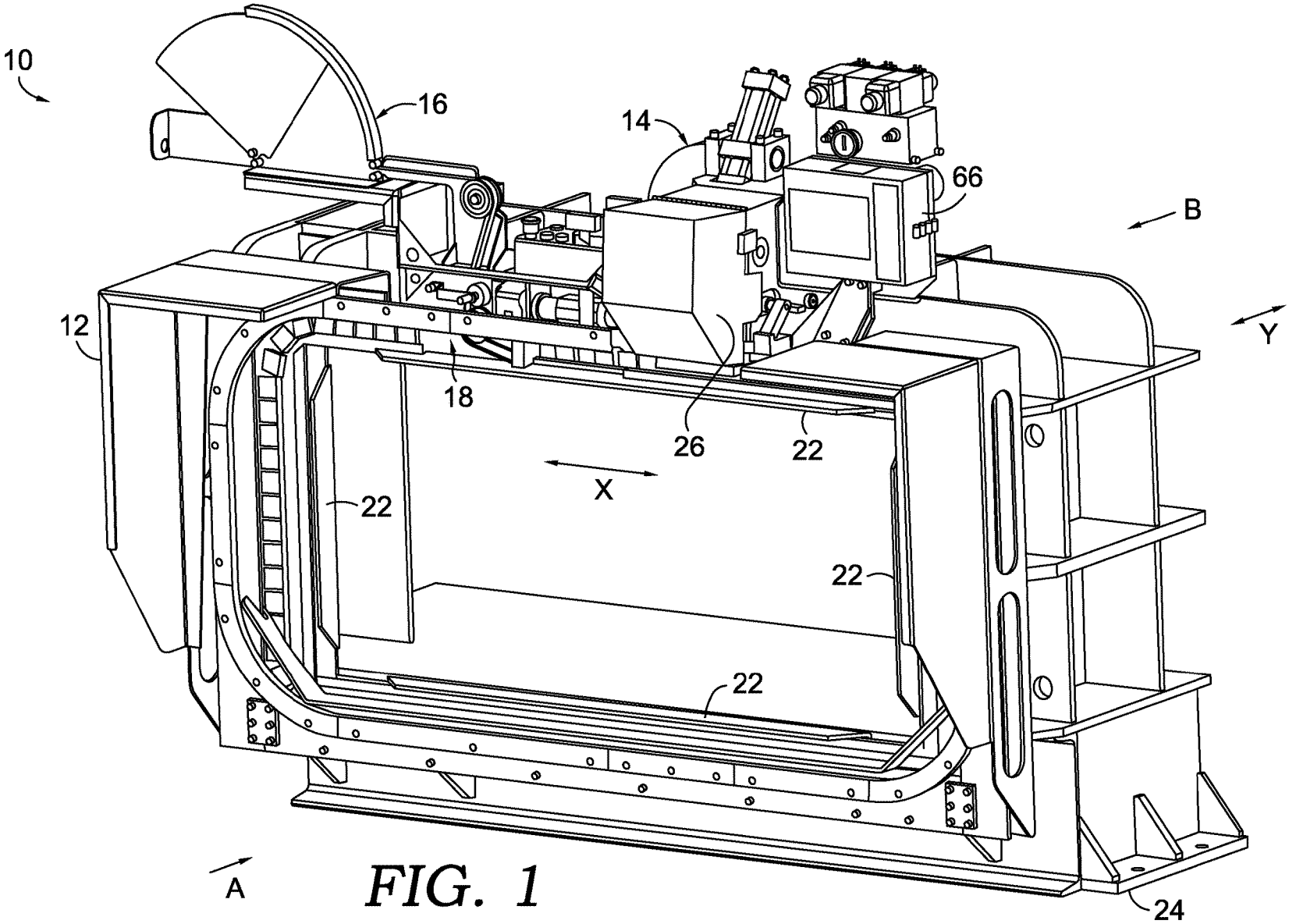
FIG. 1 is a front perspective view of an exemplary strapping machine for bulk-material baling, in accordance with an embodiment of the invention.

The present invention generally relates to a combination strapping machine for applying two different types of tying materials to a single bale, such as a bale of recycled material. In embodiments, the strapping machine is coupled to two separate tying systems and/or strapper heads for dynamically applying and/or attaching plastic straps or wire ties to a baled material. In embodiments, the two separate tying systems include a plastic tying system having a plastic closing mechanism (such as a welder) and a wire tying system having a wire closing mechanism (such as a knotter). In one embodiment, both the plastic tying system and the wire tying system are adjacent and coupled to a common strapping machine frame on one of a top, right, left, or bottom side and/or surface. In one embodiment, the plastic tying system and/or the wire tying system are located on different sides of the common strapping machine and coupled to a common strapping machine frame on one of atop, right, left, or bottom side and/or surface. As such, the tying systems may be oriented along an x-axis of the width of a strapping machine or along a z-axis of the height of the strapping machine, offset with respect to the front side and the rear side of the strapping machine along a y-axis corresponding to the front-to-rear depth of the machine.

In embodiments, a common controller may be configured to coordinate the alternating straps applied by the strapping machine to one or more bales of material. In further embodiments, the common controller may be utilized to alternately apply a plastic strap from the plastic tying system, and a wire tie from a wire tying system. In one embodiment, both the plastic tying medium and the wire tying medium are strapped around the bale using a common track perimeter of the strapping machine frame. As such, in one aspect, a plastic closing mechanism (such as a welder) of the plastic tying system offset from a wire closing mechanism (such as a knotter) of the wire tying system are used to apply both straps utilizing a common track perimeter of the strapping machine having a limited amount of space along the top side/surface. In another embodiment, both straps are applied utilizing a common track of the strapping machine.

Accordingly, in one embodiment of the invention, a combination strapping machine for use on a baler is provided. The strapping machine may include a strapping machine frame having a common track perimeter and a top side, a right side, a left side, or a bottom side; a plastic tying system coupled to one of the top side, the right side, the left side, or the bottom side of the strapping machine frame, the plastic tying system having a plastic track, wherein the plastic tying system is configured to apply a plastic strap to a baled material, the plastic tying system may include the plastic closing mechanism (such as a welder); and a wire tying system coupled to one of the top side, the right side, the left side, or the bottom side of the strapping machine frame, the wire tying system having a wire track, wherein the wire tying system is configured to apply a wire strap to the baled material, the wire tying system may include the wire closing mechanism (such as a knotter), wherein the wire track is adjacent to the plastic track, and further wherein the plastic closing mechanism may be spaced apart from the wire closing mechanism.

In some embodiments, the plastic tying system may include a plurality of bloom plates that surround the common track perimeter. In further embodiments, the bloom plates may be coupled to the common track perimeter of the strapping machine frame and are thereby configured to contact a baled material secured within an opening of the strapping machine. In further embodiments, the plastic tying system may be configured to apply the plastic strap to the baled material from a first direction relative to the common track perimeter. In one embodiment, the first direction may be clockwise. Additionally, embodiments of the wire tying system may be configured to apply the wire strap to the baled material from a second direction relative to the common track perimeter, which in some embodiments, the second direction may be counterclockwise.

In another illustrative aspect, a combination strapping machine for dynamic strapping of a first tying medium and a second tying medium on a baler may include: a strapping machine frame having a common track perimeter; a first tying system for the first tying medium, the first tying system coupled to a first portion of the strapping machine; and a second tying system for the second tying medium, the second tying system coupled to a second portion of the strapping machine, wherein the first tying system and the second tying system are configured to alternate applying straps to a baled material secured by the combination strapping machine and alternate utilizing a common track when applying the strap to the baled material. As used herein, alternate mechanisms are able to switch back and forth, but not necessarily after only a single instance. For example, the first tying system may apply one or more straps before alternating to the second tying system applying one or more straps. In embodiments, the first portion of the strapping machine is adjacent to the second portion of the strapping machine on a first side of the strapping machine frame. Additionally, in one embodiment, the common track perimeter comprises a first track for the first tying medium and a second track for the second tying medium. In another embodiment, the first tying system may be a plastic tying system positioned at a rear side of the combination strapping machine, while in further embodiments, the plastic tying system may be configured to apply a plastic strap to the baled material from a first direction relative to the common track perimeter.

In embodiments, the second tying system may be a wire tying system positioned at a front side of the combination strapping machine. As such, in some embodiments, the wire tying system may be configured to apply a wire strap to the baled material from a second direction relative to the common track perimeter. Embodiments of the combination strapping machine may be configured to apply alternating straps to a baled material secured by the combination strapping machine by applying at least one strap of the first tying medium and at least one strap of the second tying medium to the bale. Embodiments of the combination strapping machine may further include an integrated controller for controlling the first tying system and the second tying system. In some embodiments, the integrated controller may be configured to alternate tying the baled material with multiple straps of the first tying medium and multiple straps of the second tying medium, according to a particular order for applying each strap of the first tying material and each strap of the second tying material.

According to a third illustrative aspect, embodiments of the invention are directed to a method for strapping a baled material according to a predetermined order of strap application, the method comprising: receiving, by a strapping machine, a material for baling, wherein the strapping machine comprises a first tying assembly, a second tying assembly, and a common control system configured to automatically alternate control indications between the first tying assembly and the second tying assembly; applying at least one strap of a first tying medium according to the predetermined order of strap application and in response to one or more control indications from the common control system, wherein the at least one strap of the first tying medium is applied using the first tying assembly coupled to the strapping machine; and applying at least one strap of a second tying medium according to the predetermined order of strap application and in response to one or more control indications from the common control system, wherein the at least one strap of the second tying medium is applied using the second tying assembly coupled to the strapping machine.

In embodiments, the first tying medium comprises a plastic tying medium. In further embodiments, the second tying medium comprises a wire tying medium. In one embodiment, the method further comprises: advancing the material to be baled to a first position; upon advancing the material to be baled to the first position, providing a first control indication to the first tying assembly to apply a first strap comprised of the first tying medium to the material to be baled; advancing the material to be baled to a second position; upon advancing the material to be baled to the second position, providing a second control indication to the second tying assembly to apply a second strap comprised of the second tying medium to the material to be baled; advancing the material to be baled to third position; and upon advancing the material to be baled to the third position, providing a third control indication to the first tying assembly to apply a third strap comprised of the first tying medium to the material to be baled.

In another embodiment, the method further comprises: advancing the material to be baled to a plurality of intermediate positions between the first position and the third position and upon each advancement to an intermediate position, providing a control indication to one of the first tying assembly and the second tying assembly to apply an additional strap comprised of the first or second tying medium, respectively, to the material to be baled.

With reference now to FIG. 1, an embodiment of a strapping machine 10 may include a strapping machine frame 12 coupled to a wire tying system 14 and a plastic tying system 16. Both the wire tying system 14 and the plastic tying system 16 may be configured to apply a tying medium to a baled material via the common track perimeter 18. As shown in the embodiment of FIG. 1, based on the application of plastic tying medium to a baled material, the common strapping machine includes bloom plates 22 coupled to the strapping machine frame 12. In some embodiments, the common base 24 supports the strapping machine frame 12 having a wire tying system 14 and a plastic tying system 16 on a top surface.

The exemplary strapping machine 10 also includes a knotter assembly 26 of the wire tying system 14. Embodiments of the invention include a knotter assembly 26 for tying a wire strap around a baled material, such as the knotter assembly described in one or more of the following U.S. patent applications: U.S. application Ser. No. 12/717,616, filed Mar. 4, 2010, entitled "Knotter Assembly," now U.S. Pat. No. 8,397,632, issued Mar. 19, 2013; U.S. application Ser. No. 13/220,798, filed Aug. 30, 2011, entitled "Knotter Assembly," and U.S. application Ser. No. 13/753,188, filed Jan. 29, 2013, entitled "Method For Removing A Twist-Module Sub-Assembly In A Knotter Assembly," the disclosure of each of which is hereby incorporated by reference in its entirety.

Additionally, as shown in FIG. 1, the strapping machine 10 may include a control system 66 coupled directly or indirectly to the strapping machine 10. For example, the strapping machine 10, having both a wire tying system 14 and a plastic tying system 16, may include a common control system 66 configured to control both tying media, such as the control system described in U.S. Application No. 61/873,662, filed Sep. 4, 2013, entitled "Control User Interface For Tying System," the disclosure of which is hereby incorporated by reference in its entirety.

As further depicted in FIG. 1, the strapping machine 10 includes a front side A and a rear side B, oriented with respect to a y-axis. In embodiments, the wire tying system 14 is configured towards the front side A of the strapping machine frame 12, while the plastic tying system is configured towards the rear side B of the strapping machine frame 12. Additionally, in some embodiments, wire tying system 14 and plastic tying system 16 may be oriented along a common x-axis, on a top surface of the strapping machine 10. In other embodiments, the wire tying system 14, the plastic tying system 16, or both the wire tying system 14 and the plastic tying system 16 may be positioned on a side surface, a bottom surface, a top surface of the strapping machine 10, or a combination of multiple different surfaces and/or sides of the strapping machine 10. For example, as depicted in the front view of FIG. 3C, the wire tying system 14 and knotter assembly 26 is positioned on a side surface of the strapping machine 10 and the wire tying system 16 is positioned on a top surface of the strapping machine 10.

Figures 2A, 2B:
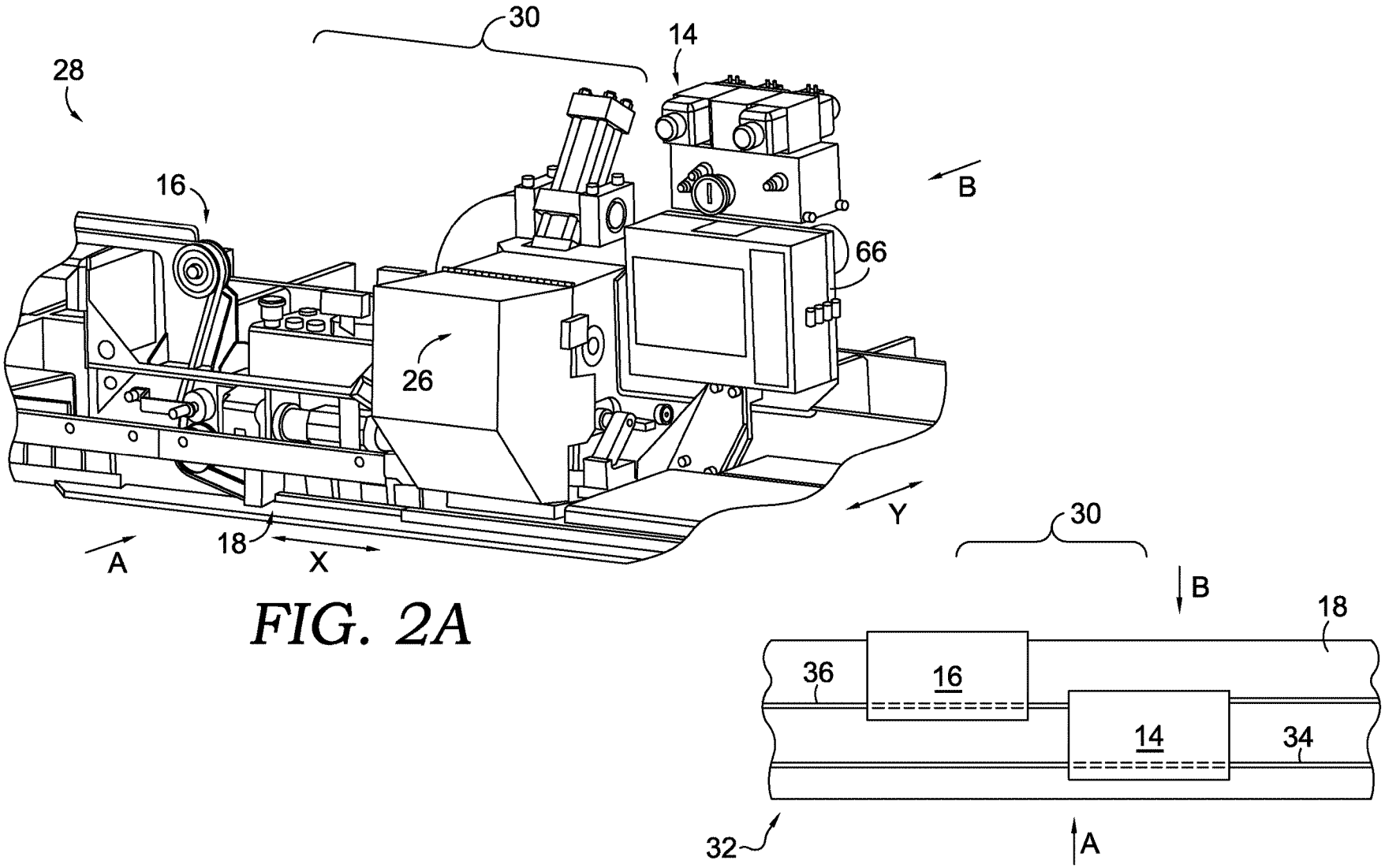
FIG. 2A is an enlarged, front perspective view of the strapping machine of FIG. 1, in accordance with an embodiment of the invention.
FIG. 2B is a top, schematic diagram of the components of an exemplary strapping machine, in accordance with an embodiment of the invention.

As further shown in the enlarged, perspective view 28 of FIG. 2A, the tying portion 30 may be located on the top of the strapping machine 10 and may include at least a portion of the wire tying system 14 and at least a portion of the plastic tying system 16. In other embodiments, there may be more than one tying portion 30. For example, as depicted in FIG. 3C, there is a tying portion 30 associated with the top of the strapping machine 10 that includes a portion of the plastic tying system 16 and a second tying portion 31 associated with the side of the strapping machine 10 that includes a portion of the wire tying system 14.

In embodiments, a portion of each of the wire tying system 14 and the plastic tying system 16 may be offset with respect to the common track perimeter 18, enabling a wire track to be positioned adjacent a plastic track along a common track perimeter 18. Accordingly, as shown in the top, schematic diagram 32 of FIG. 2B, the common track perimeter 18 may be configured to secure both a wire strap 34 (from a wire tying system 14) and a plastic strap 36 (from a plastic tying system 16). In one embodiment, a common track perimeter 18 may refer to a single channel surrounding a baled material that receives both a first and a second tying material. In another embodiment, a common track perimeter 18 may refer to a multi-channel feature surrounding a baled material that receives a first tying material via a first channel and receives a second tying material via a second channel adjacent and/or parallel to the first channel.

Figure 3A:
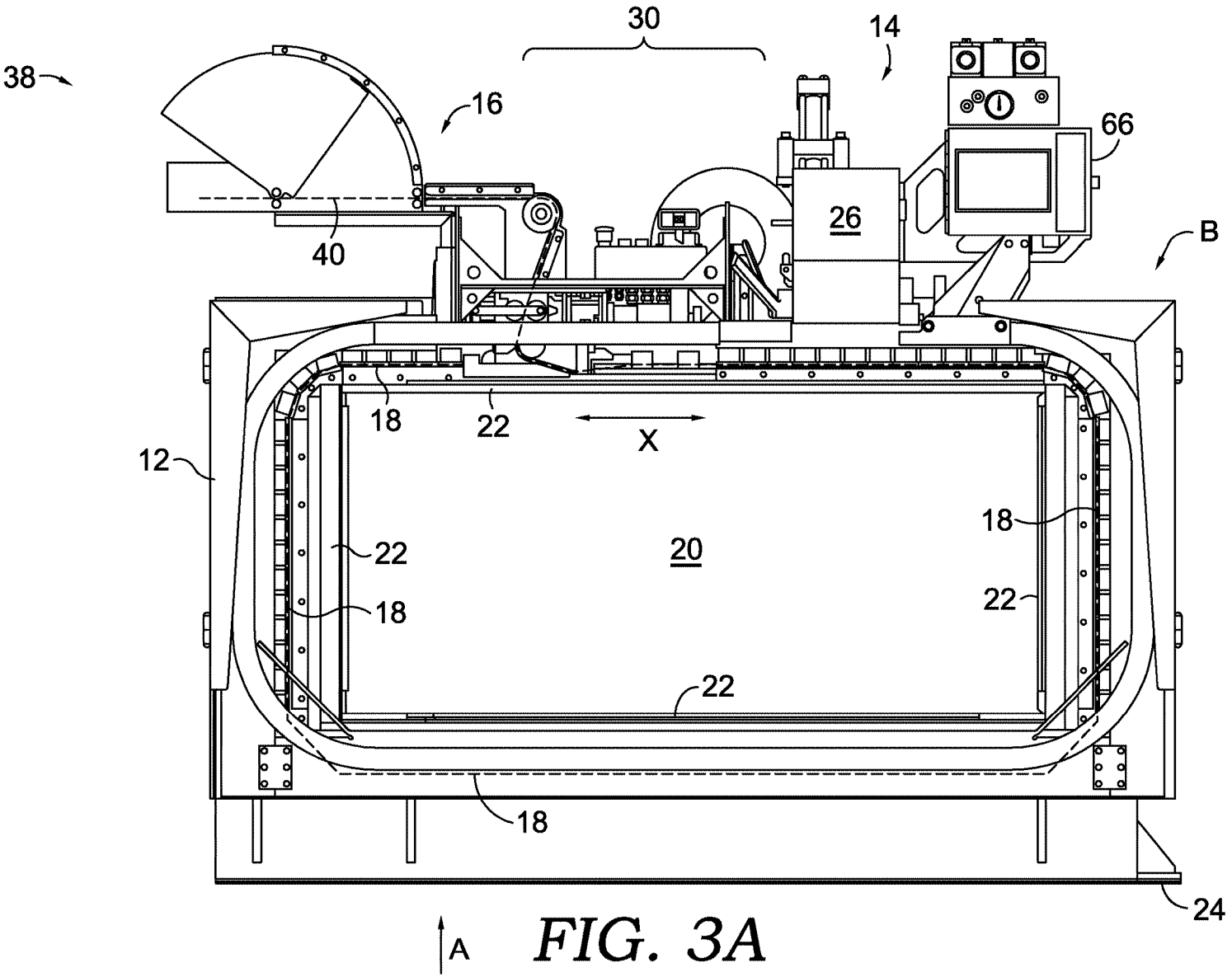
FIG. 3A is a front view of an exemplary strapping machine applying a plastic strap using a plastic tying system, in accordance with an embodiment of the invention.
Figure 3B:
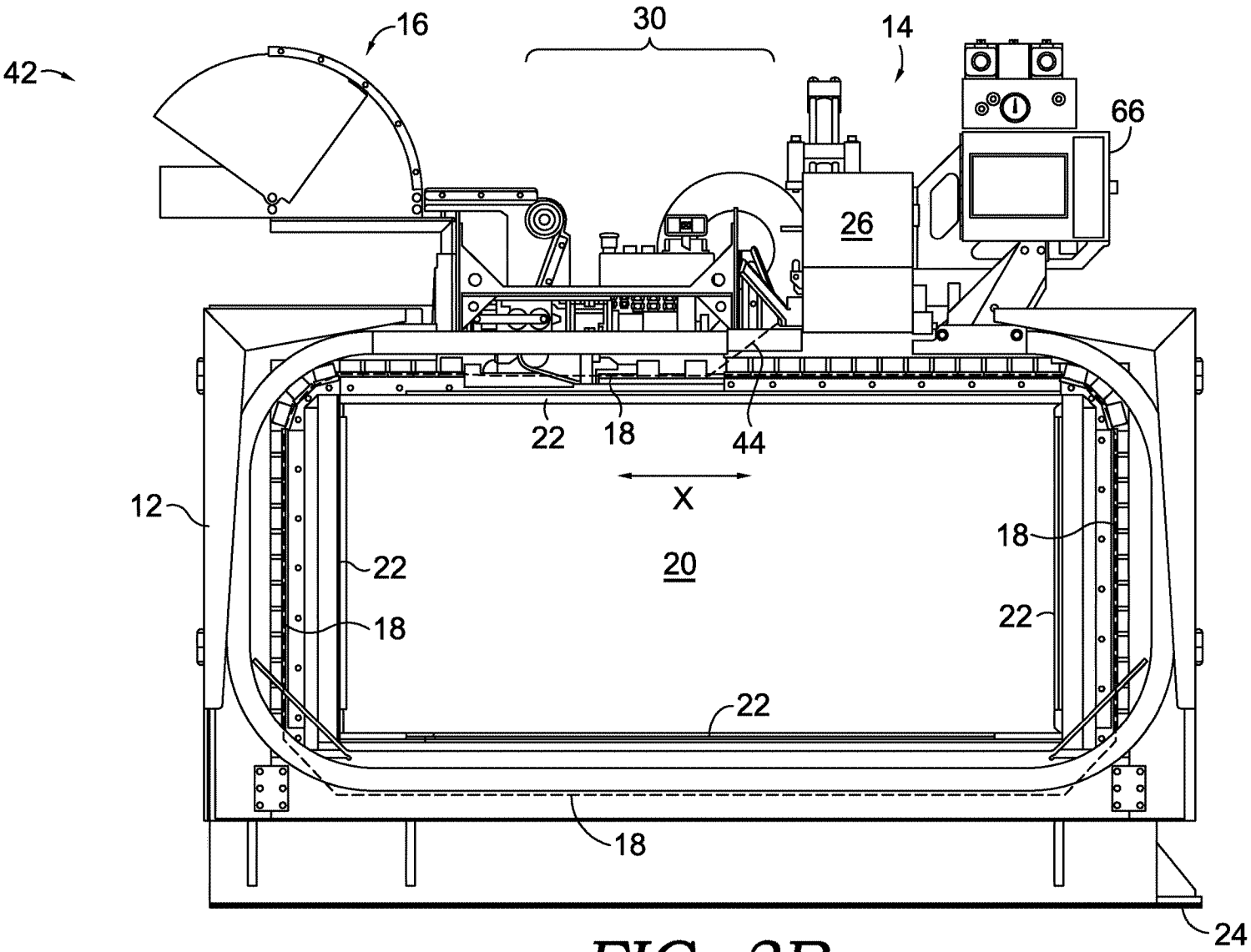
FIG. 3B is a front view of an exemplary strapping machine applying a wire strap using a wire tying system, in accordance with an embodiment of the invention.
Figure 3C:
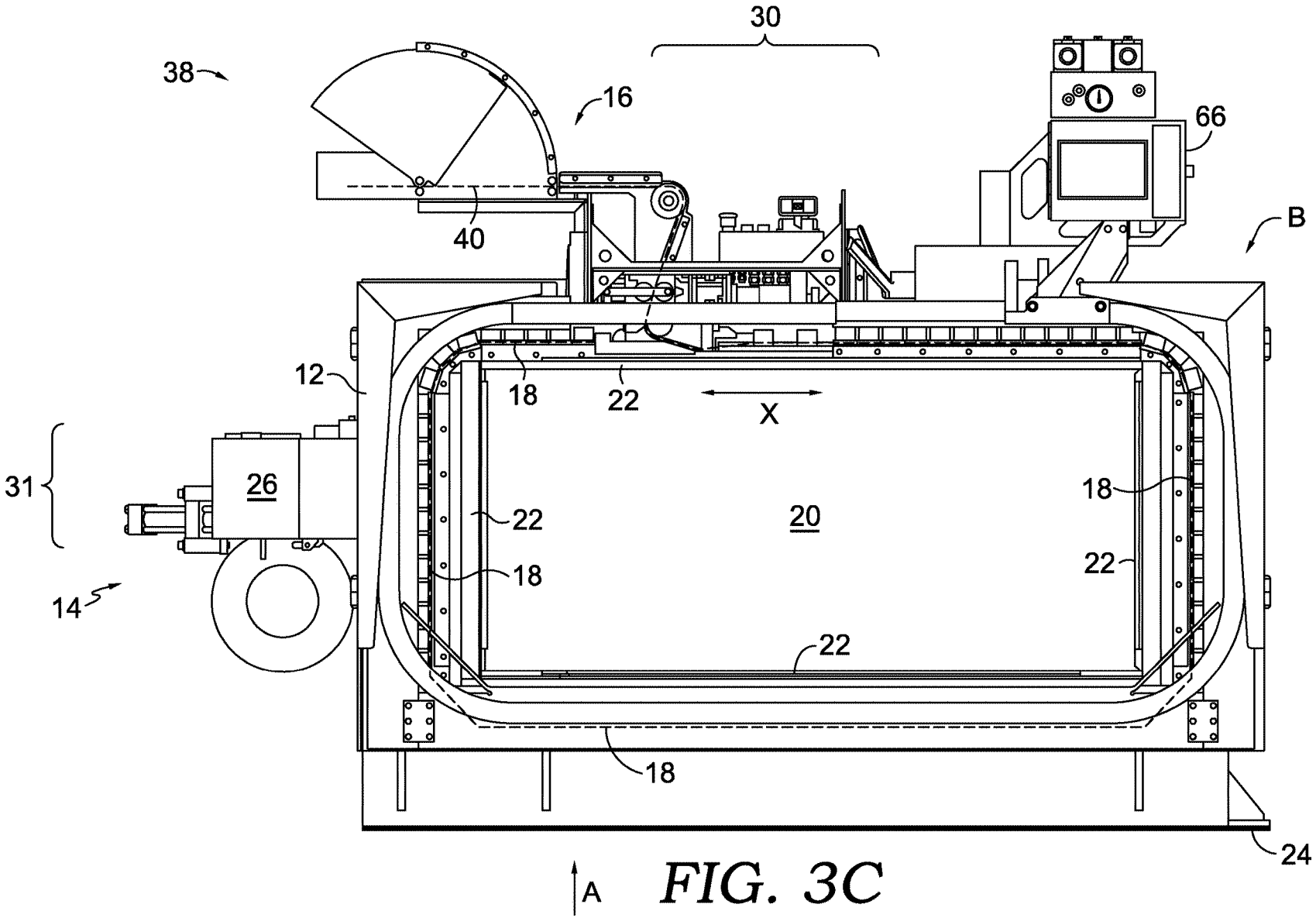
FIG. 3C is a front view of an exemplary strapping machine having a wire tying system located on a side surface of the strapping machine and a plastic tying system located on a top surface of the strapping machine.

Referring next to FIG. 3A, a front view of an exemplary strapping machine 38 depicts the application of a plastic strap 40 around a material based through opening 20, according to one embodiment of the invention. In a further embodiment, the plastic strap 40 may be applied using the plastic tying system 16 by travelling along the common track perimeter 18 in a clockwise direction. As shown in FIG. 3B, a front view of an exemplary strapping machine 42 depicts the application of a wire strap 44 around a material baled through opening 20, according to one embodiment of the invention. In a further embodiment, the wire strap 44 may be applied using the wire tying system 14 by travelling along the common track perimeter 18 in a counterclockwise direction.

Figure 4A:
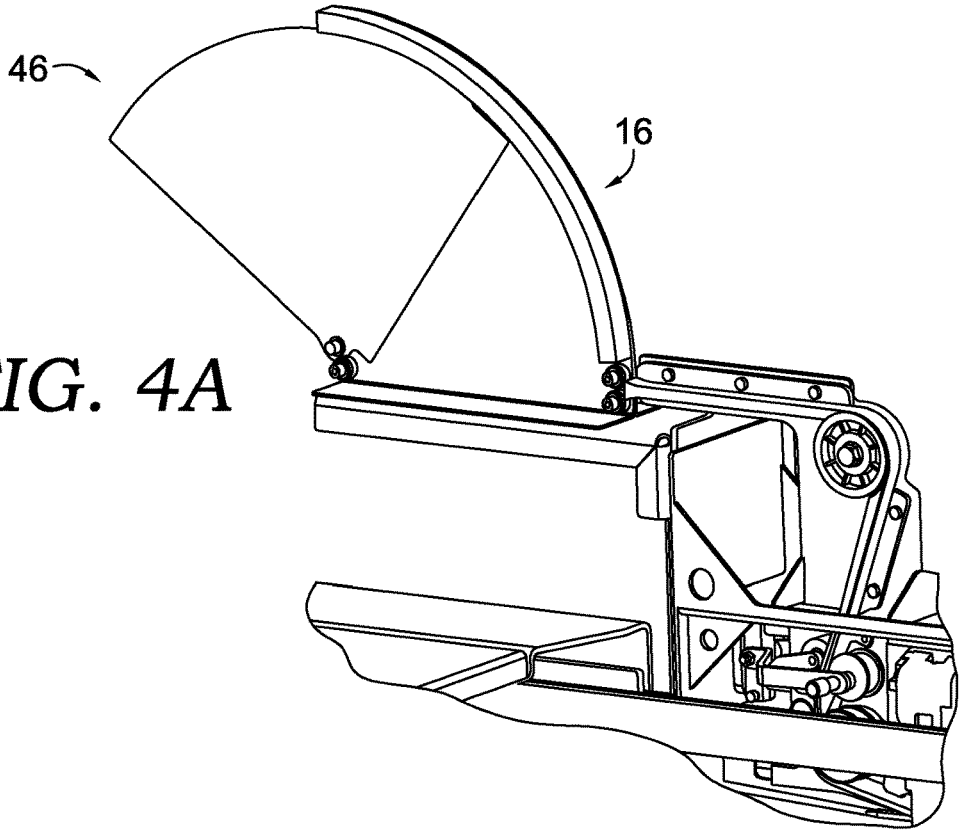
FIG. 4A is an enlarged, perspective view of the plastic tying system of FIG. 1, in accordance with an embodiment of the invention.

Turning next to FIG. 4A, an enlarged, perspective view 46 of the plastic tying system 16 is depicted according to an embodiment of the invention. In embodiments, the plastic tying system 16 utilizes a plastic closing mechanism to join a plastic strap around a baled material. In some aspects, the plastic closing mechanism comprises a thermal welding head for sealing of two portions of the plastic strap together. In other aspects, the plastic closing mechanism comprises a hot knife system. In yet other aspects, the plastic closing mechanism comprises a friction inducing mechanism, such as a vibrating platen and/or anvil, used to join two portions of the plastic strap together. In still other aspects, the plastic closing mechanism comprises crimping or buckling two portions of the plastic strap together. It is understood that the plastic closing mechanism may comprise any suitable mechanism for joining two portions of the plastic strap together to seal the plastic strap around the baled material. In several embodiments, plastic tying system 16 incorporates one tying portion 30 (FIG. 2A).

Figure 4B:
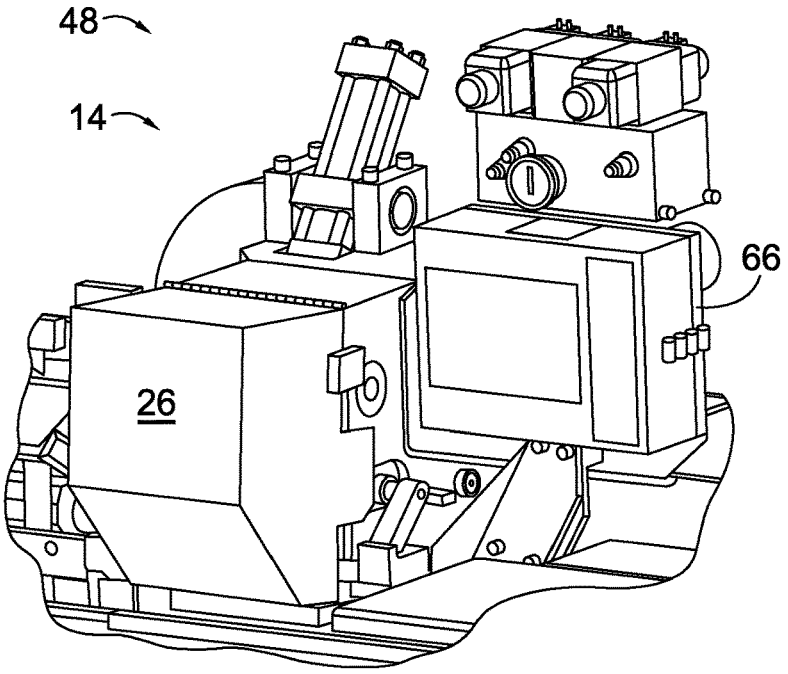
FIG. 4B is an enlarged, perspective view of the wire tying system of FIG. 1, in accordance with an embodiment of the invention.

In further embodiments, based on application of a wire strap around a perimeter of a baled material, the applied material may be secured using reverse tensioning. With reference to FIG. 4B, an enlarged, perspective view 48 of the wire tying system 14 is shown in accordance with an embodiment of the invention. Embodiments of the wire tying system 14 may include a wire closing mechanism to join a wire strap around a baled material, the wire closing mechanism may be controlled by the control system 66. In some aspects, the wire closing mechanism comprises a knotter assembly 26 for knotting two portions of the wire together. In other aspects, the wire closing mechanism comprises a welder for welding two portions of the wire together. In yet other aspects, the wire closing mechanism comprises a joint sealer for creating a seal and notch joint, a seal and crimp, or a seal-less joint in two portions of the wire. It is understood that the wire closing mechanism may comprise any suitable mechanisms for joining two portions of the wire together to seal the wire strap around the baled material.

Figure 5:
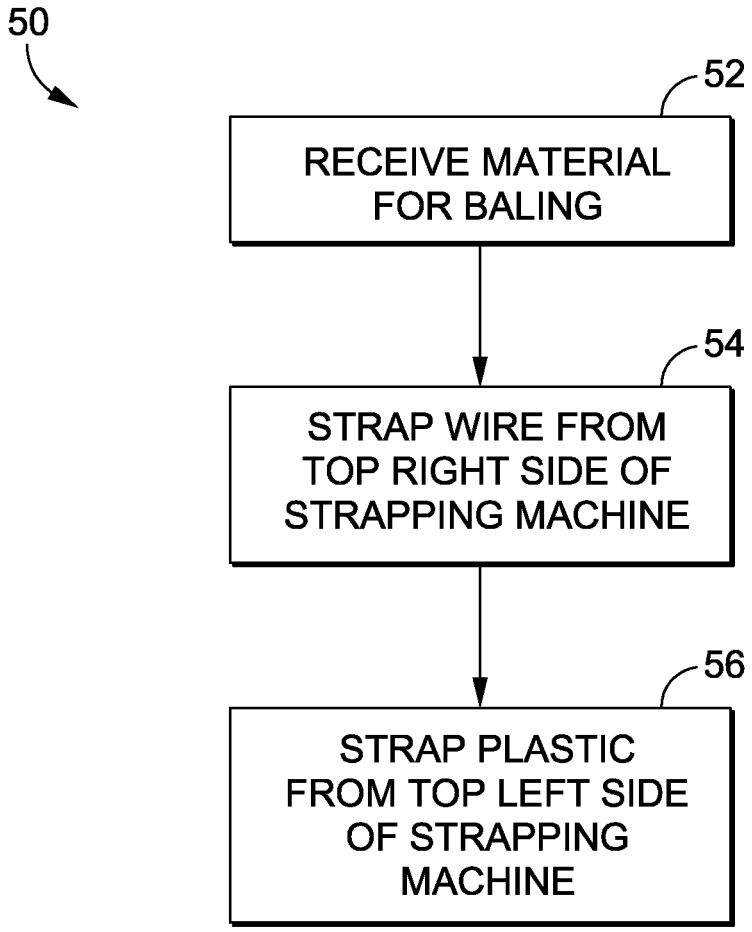
FIG. 5 is a flow diagram of a method of tying a plastic strap and a wire strap using a common strapping machine, in accordance with an embodiment of the invention.

With reference to the flow diagram of FIG. 5, an exemplary method 50 of tying a plastic strap and a wire strap using a common strapping machine in accordance with one embodiment is provided. At block 52, a material is received for baling, such as a recycled and/or waste material. At block 54, wire is strapped from a top right side of the strapping machine. In embodiments, based on strapping the wire from a top right side of the strapping machine, the wire continues through the common track perimeter of the strapping machine in a counterclockwise direction. At block 56, a plastic strap is applied from a top left side of the strapping machine. Accordingly, the plastic strap continues through the common track perimeter of the strapping machine in a clockwise direction, according to embodiments of the invention. It is understood that the wire may be strapped from any side along the strapping machine perimeter and not only from the top right side of the strapping machine. Likewise, it is understood that plastic strap may be applied from any side along the strapping machine perimeter and not only from the top left side.

Figure 6:
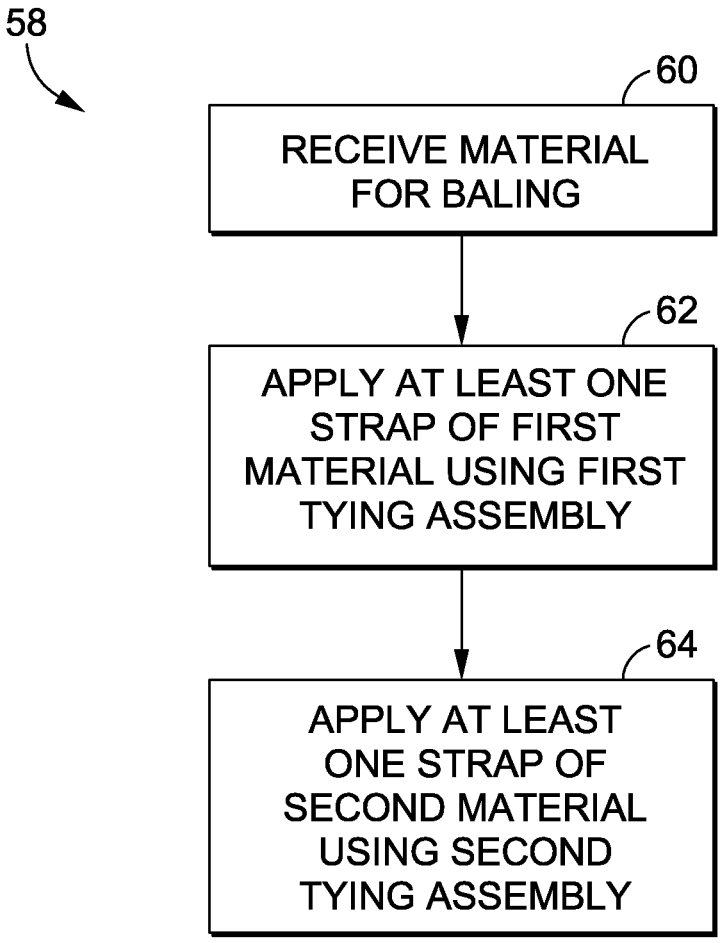
FIG. 6 is a flow diagram of a method of applying a strap of a first material and a strap of a second material using a common strapping machine, in accordance with an embodiment of the invention.

Referring to the flow diagram of FIG. 6, an exemplary method 58 of applying a strap of a first material and a strap of a second material using a common strapping machine is described in accordance with an embodiment of the invention. At block 60, a material for baling is received, such as a recycled and/or waste material. At block 62, at least one strap of a first material is applied to the bale using a first tying assembly. In embodiments, the first material is applied to the bale in a first direction around the common track perimeter. At block 64, at least one strap of a second material is applied to the bale using a second tying assembly. In embodiments, the second material is applied to the bale in a second direction around the common track perimeter. In embodiments, the second direction is opposite the first direction, and the second material and/or tying medium is different than the first material and/or tying medium.

As such, when using a common strapping machine for tying a first strap of a first material and a second strap of a second material, in some embodiments of the invention, a particular order of strap application of multiple types of tying media may be executed. As such, a "recipe" for order of strap application of different types of straps, such as wire straps and plastic straps, may be provided and utilized by a single, common strapping machine. For example, in one embodiment, a recipe for strapping may include a series of commands for applying 1) a wire strap to a first end of a bale, 2) a plastic strap to the middle of the bale, and 3) an additional wire strap at the second end of the bale. Accordingly, in one embodiment, the baled material may be secured by a wire strap at either end of the baled material, with any combination of wire and/or plastic straps on a middle portion of the bale. In further embodiments, beginning, middle, and end portions of a bale for tying using the strapping machine may be identified by the strapping machine control system, and tied accordingly. As such, different characteristics of different portions of a baled material (i.e., along the y-axis of the strapping machine) may require a different tying mechanism and/or strapping medium. In embodiments, the common strapping machine dynamically adjusts to apply different tying straps to different portions of a bale, such as applying multiple different plastic straps and wire straps to a single bale.

In one embodiment, the offset positioning of the plastic tying system and wire tying system provides a tying portion of the strapping machine that is configured to alternate between one type of tying medium and another, without adjusting and/or removing a portion of the strapping mechanism. In some embodiments, the wire tying system is positioned in front of and higher than the plastic tying system. As such, in some embodiments, the wire tying system is closer to the front side A of the strapping machine, while the plastic tying system is closer to the rear side B of the strapping machine. Additionally, in some embodiments, a portion of the wire tying system is positioned a particular distance apart from the plastic tying system, when oriented along the same x-axis.

In some embodiments, the wire tying assembly and the plastic tying assembly may utilize the same path for travel of the various tying media. In some embodiments, the two tying assemblies may share the same path for travel while not needing to change a part of the wire tying assembly or the plastic tying assembly and while maintaining tension around the bale. For example, a common track path may be utilized for applying both a first tying medium and a second tying medium to a baled material, with each material being strapped/applied/terminated on the same or different sides of the of the dual-component tying system. For another example, a common frame path may be utilized for applying both a first tying medium and a second tying medium to a baled material on a non-common track path, with each material being strapped/applied/terminated on the same or different sides of the of the dual-component tying system.

In other embodiments, a common track may be utilized by the wire tying assembly and the plastic tying assembly to tie a plurality of straps from beginning to end of a single bale. In some embodiments, the common track may be utilized by advancing the single bale through the baling machine, applying at least one strap of a first tying medium from a first closing mechanism location on the common track, and applying at least one strap of a second tying medium from a second closing mechanism location on the common track, where the first closing mechanism location is different from the second closing mechanism location.

Figure 7:
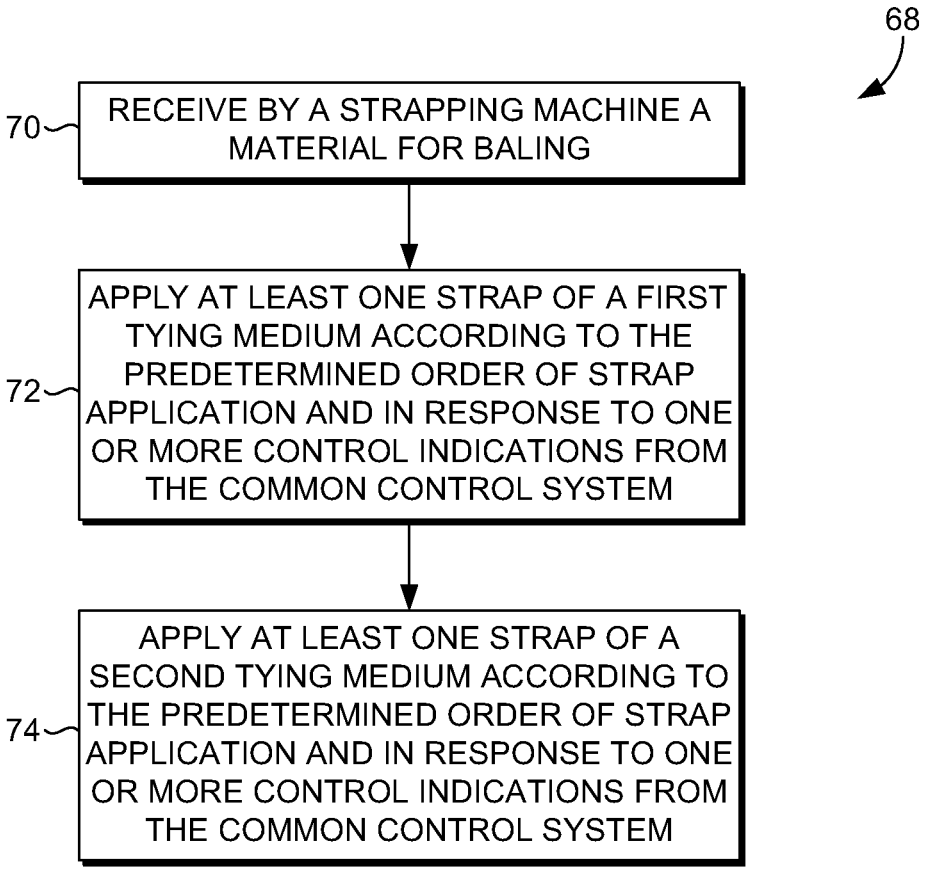
FIG. 7 is a flow diagram of a method for strapping a baled material according to a predetermined order of strap application, in accordance with an embodiment of the invention.

Referring to FIG. 7, in another embodiment, a method 68 of strapping a baled material according to a predetermined order of strap application is provided. In one aspect, the method 68 includes receiving, by a strapping machine, a material for baling, as depicted at block 70. The strapping machine may comprise a first tying assembly, a second tying assembly, and a common control system configured to automatically alternate control indications between the first tying assembly and the second tying assembly. In another aspect, the method 68 includes applying at least one strap of a first tying medium according to the predetermined order of strap application and in response to one or more control indications from the common control system, as depicted in block 72. The at least one strap of the first tying medium may be applied using the first tying assembly coupled to the strapping machine. In another aspect, the method 68 includes applying at least one strap of a second tying medium according to the predetermined order of strap application and in response to one or more control indications from the common control system, as depicted in block 74. The at least one strap of the second tying medium may be applied using the second tying assembly coupled to the strapping machine.

In some aspects, the first tying medium comprises a plastic tying medium. In other aspects, the second tying medium comprises a wire tying medium. It is understood that the first and second tying mediums may comprise other suitable material tying mediums (such as polyester) so long as the first tying medium is different from the second tying medium.

In one embodiment, the method 68 may further include advancing the material to be baled to a first position; and upon advancing the material to be baled to the first position, providing a first control indication to the first tying assembly to apply a first strap comprised of the first tying medium to the material to be baled. The method 68 may further include advancing the material to be baled to a second position; and upon advancing the material to be baled to the second position, providing a second control indication to the second tying assembly to apply a second strap comprised of the second tying medium to the material to be baled. The method 68 may further include advancing the material to be baled to a third position; and upon advancing the material to be baled to the third position, providing a third control indication to the first tying assembly to apply a third strap comprised of the first tying medium to the material to be baled.

In yet another embodiment, the method 68 may further comprise advancing the material to be baled to a plurality of intermediate positions between the first position and the third position, and upon each advancement to an intermediate position, providing a control indication to one of the first tying assembly and the second tying assembly to apply an additional strap comprised of the first tying medium or the second tying medium, respectively, to the material to be baled.

From the foregoing, it will be seen that this invention is one well adapted to attain all the ends and objects hereinabove set forth together with other advantages, which are obvious and inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matters herein set forth or shown in the accompanying drawings is to be interpreted as illustrative and not in a limiting sense.

We claim:

1. A combination strapping machine for dynamic strapping of a first tying medium and a second tying medium on a baler, the strapping machine comprising:

a strapping machine frame having a common track with a common track perimeter;

a first tying system for the first tying medium, the first tying system coupled to a first portion of the strapping machine; and a second tying system for the second tying medium, the second tying system coupled to a second portion of the strapping machine, wherein said first tying system and said second tying system are oriented along a common x-axis;

wherein the first tying system and the second tying system are configured to alternate applying a first strap and a second strap to a baled material secured by the combination strapping machine and alternately utilizing the common track when applying the first strap and the second strap to the baled material; and wherein the first strap and the second strap are parallel relative to each other.

2. The combination strapping machine of claim 1, wherein the first portion of the strapping machine is adjacent to the second portion of the strapping machine on a first side of the strapping machine frame.

3. The combination strapping machine of claim 1, wherein the second tying system is a plastic tying system positioned at a rear side of the combination strapping machine.

4. The combination strapping machine of claim 3, wherein the plastic tying system is configured to apply a plastic strap to the baled material from a direction relative to the common track perimeter.

5. The combination strapping machine of claim 1, wherein the first tying system is a wire tying system positioned at a front side of the combination strapping machine.

6. The combination strapping machine of claim 5, wherein the wire tying system is configured to apply a wire strap to the baled material from a direction relative to the common track perimeter.

7. The combination strapping machine of claim 1, wherein to alternate applying a strap to a baled material secured by the combination strapping machine comprises applying at least one strap of the first tying medium and at least one strap of the second tying medium to the bale.

8. The combination strapping machine of claim 1, further comprising an integrated controller for controlling the first tying system and the second tying system.

9. The combination strapping machine of claim 1, wherein a common control system is configured to alternate tying the baled material with multiple straps of the first tying medium and multiple straps of the second tying medium according to a predetermined order of strap application for applying the first tying medium and each strap of the second tying medium.

* * * * *